US008032359B2

(12) United States Patent
Shlomot et al.

(10) Patent No.: US 8,032,359 B2
(45) Date of Patent: Oct. 4, 2011

(54) EMBEDDED SILENCE AND BACKGROUND NOISE COMPRESSION

(75) Inventors: Eyal Shlomot, Long Beach, CA (US); Yang Gao, Mission Viejo, CA (US); Adil Benyassine, Irvine, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 948 days.

(21) Appl. No.: 12/002,131

(22) Filed: Dec. 14, 2007

(65) Prior Publication Data

US 2008/0195383 A1 Aug. 14, 2008

Related U.S. Application Data

(60) Provisional application No. 60/901,191, filed on Feb. 14, 2007.

(51) Int. Cl.
*G10L 21/00* (2006.01)
*G10L 11/06* (2006.01)

(52) U.S. Cl. ..... 704/201; 704/210; 704/215

(58) Field of Classification Search ..... 704/201–230
See application file for complete search history.

(56) References Cited

U.S. PATENT DOCUMENTS

| | | | | |
|---|---|---|---|---|
| 5,867,815 | A * | 2/1999 | Kondo et al. | 704/228 |
| 7,330,814 | B2 * | 2/2008 | McCree | 704/219 |
| 2005/0004793 | A1 * | 1/2005 | Ojala et al. | 704/219 |
| 2006/0149538 | A1 * | 7/2006 | Lee et al. | 704/219 |

OTHER PUBLICATIONS

Benyassine, et al., *ITU-T Recommendation G.729 Annex B: A Silence Compression Scheme for Use with G.729 Optimized for V.70 Digital Simultaneous Voice and Data Applications*, IEEE, vol. 35, No. 9, 64-73 (Sep. 1997).

Jelinek, et al., *Advances in Source-Controlled Variable Bit Rate Wideband Speech Coding*, Special Workshop in Maui (SWIM): Lectures by Masters in Speechprocessing, 1-8 (Jan. 2004).

McCree, et al., *An Embedded Adaptive Multi-Rate Wideband Speech Coder*, 2001 IEEE International Conference on Acoustics, Speech, and Signal Processing Proceedings, IEEE, vol. 2, (May 2001).

"Coding of Speech at 8 kbit/s Using Conjugate-Structure Algebraic-Code-Excited Linear-Prediction (CS-ACELP)", ITU-T, G.729 (Mar. 1996).

"Annex B: A silence compression scheme for G.729 optimized for terminals conforming to Recommendation V.70" ITU-T, G.729 Annex B (Nov. 1996).

"G.729-based embedded variable bit-rate coder: An 8-32 kbit/s scalable wideband coder bitstream interoperable with G.729" ITU-T, G.729.1 (May 2006).

* cited by examiner

*Primary Examiner* — Samuel G Neway
(74) *Attorney, Agent, or Firm* — Farjami & Farjami LLP

(57) ABSTRACT

There is provided a method for use by a speech encoder to encode an input speech signal. The method comprises receiving the input speech signal; determining whether the input speech signal includes an active speech signal or an inactive speech signal; low-pass filtering the inactive speech signal to generate a narrowband inactive speech signal; high-pass filtering the inactive speech signal to generate a high-band inactive speech signal; encoding the narrowband inactive speech signal using a narrowband inactive speech encoder to generate an encoded narrowband inactive speech; generating a low-to-high auxiliary signal by the narrowband inactive speech encoder based on the narrowband inactive speech signal; encoding the high-band inactive speech signal using a wideband inactive speech encoder to generate an encoded wideband inactive speech based on the low-to-high auxiliary signal from the narrowband inactive speech encoder; and transmitting the encoded narrowband inactive speech and the encoded wideband inactive speech.

14 Claims, 13 Drawing Sheets

Silence/Background-Noise Encoding Mode for G.729.1 with Narrowband VAD

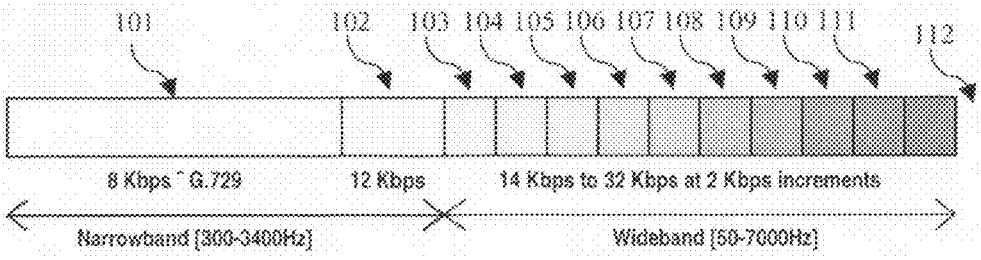
Figure 1: Embedded Structure of G.729.1 Bitstream
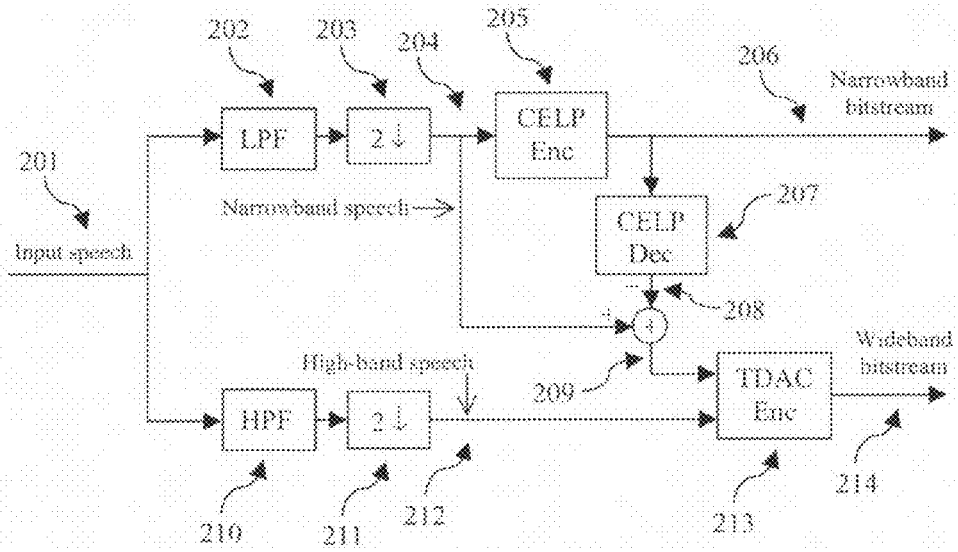
Figure 2: Structure of G.729.1 Encoder

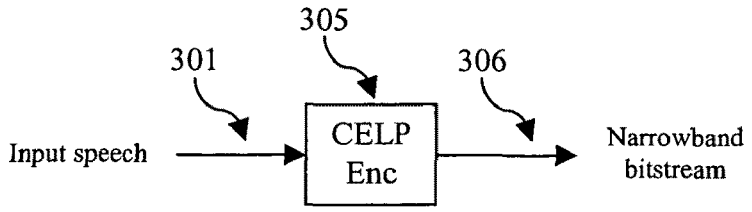
Figure 3: Alternative Operation of G.729.1 Encoder – Narrowband Coding
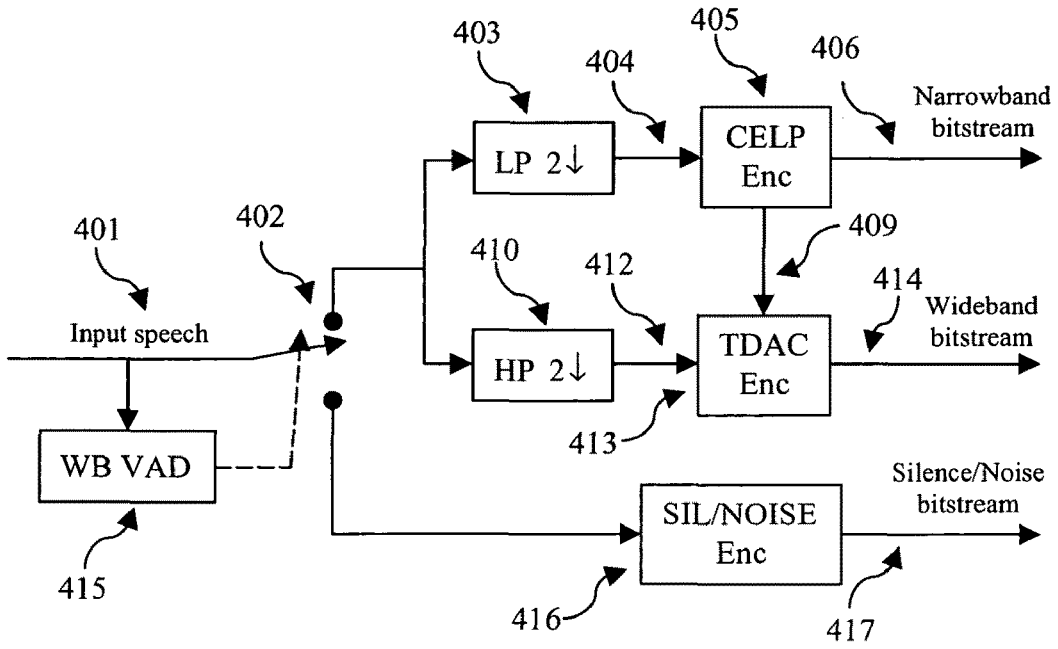
Figure 4: Silence/Background-Noise Encoding Mode for G.729.1

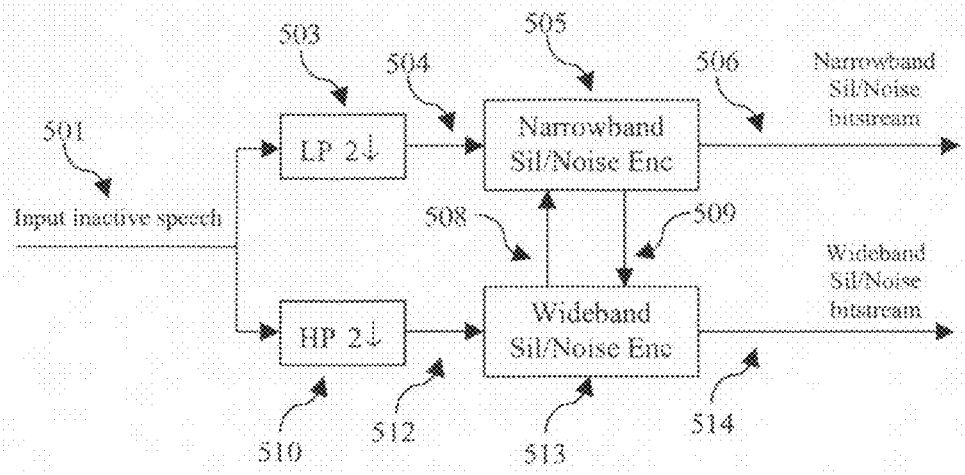
Figure 5: Silence/Background-Noise Encoder with Embedded Structure
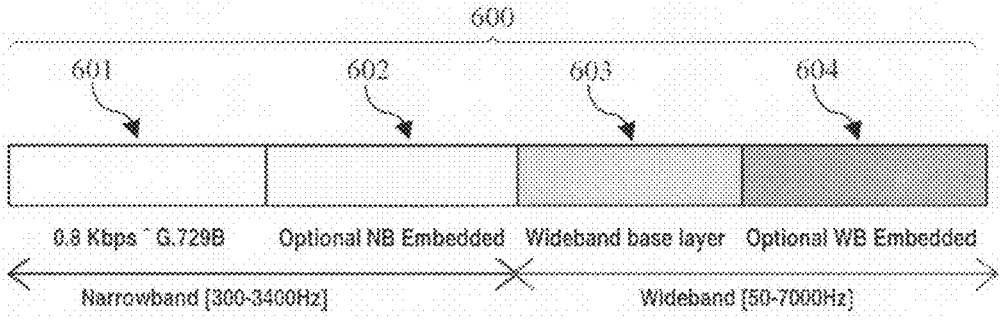
Figure 6: Silence/Background-Noise Embedded Bitstream
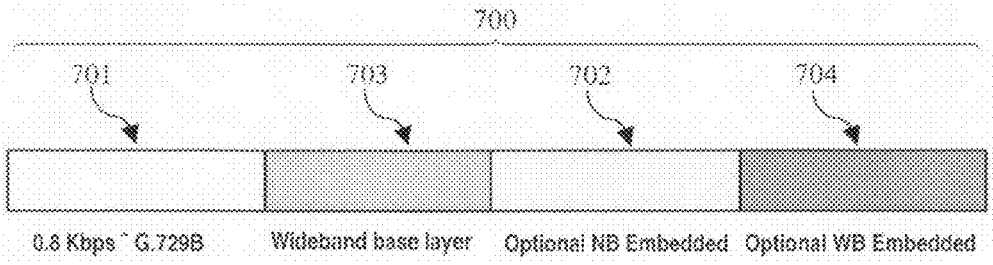
Figure 7: Alternative Silence/Background-Noise Embedded Bitstream

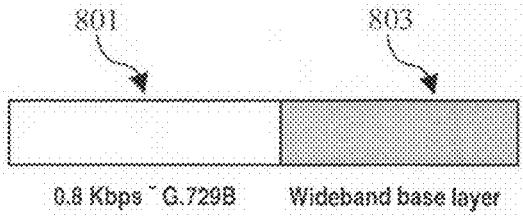
Figure 8: Silence/Background-Noise Embedded Bitstream without Optional Layers
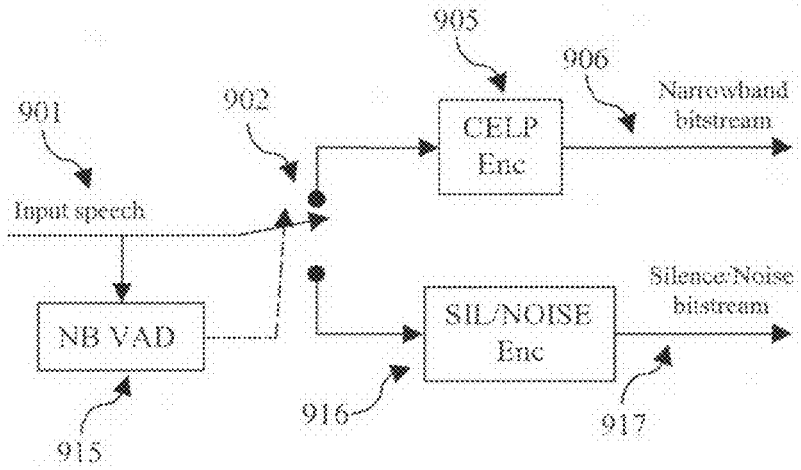
Figure 9: Narrowband VAD for Narrowband Mode of Operation of G.729.1

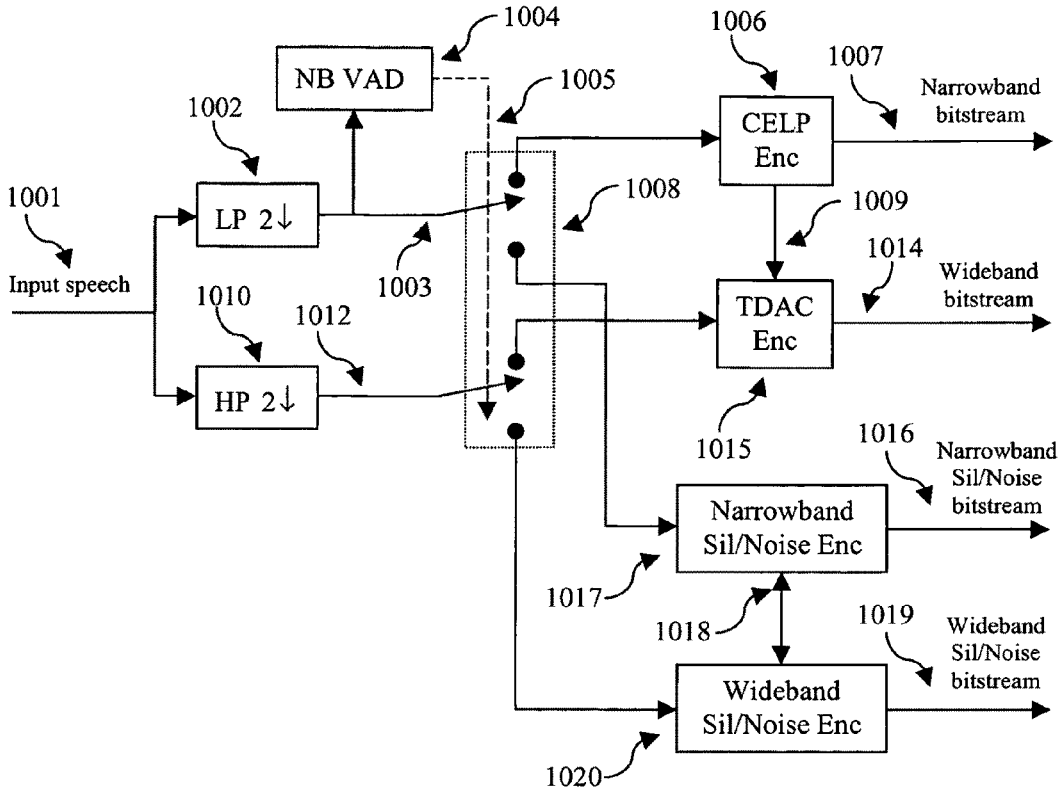
Figure 10: Silence/Background-Noise Encoding Mode for G.729.1 with Narrowband VAD

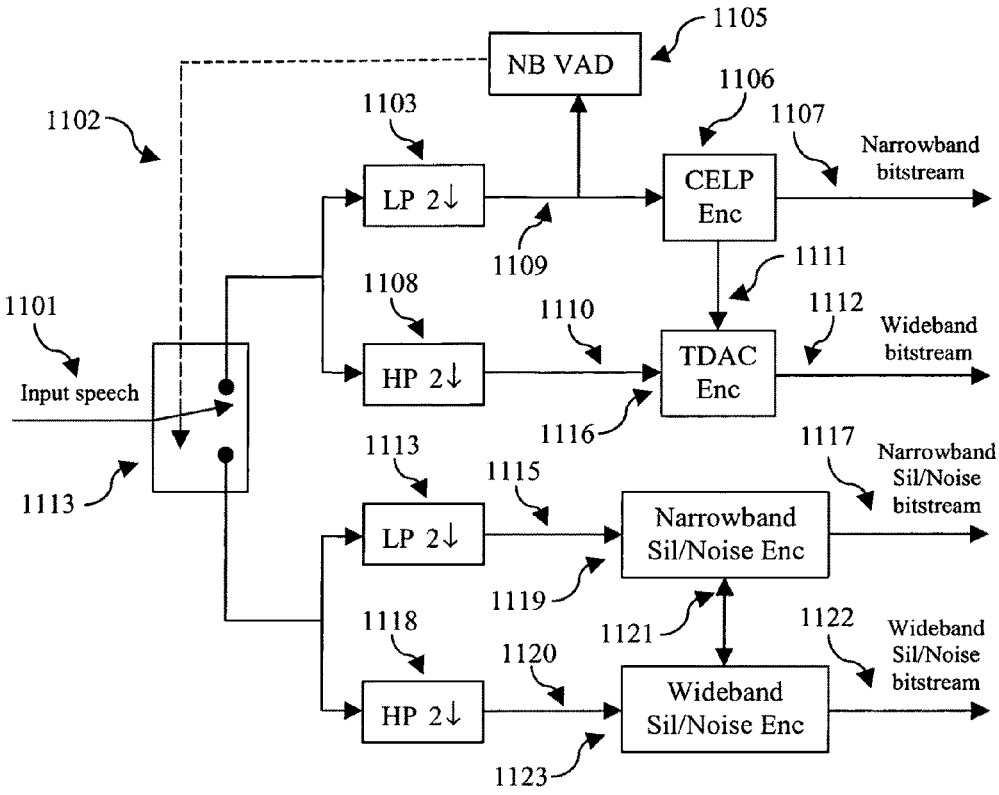
Figure 11: Silence/Background-Noise Encoding Mode for G.729.1 with Narrowband VAD and Separate Decimation Elements

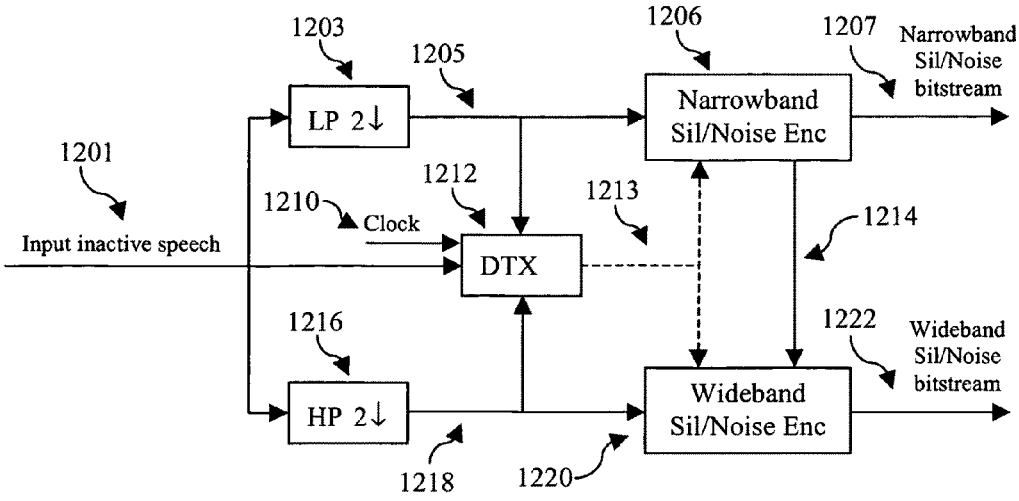
Figure 12: Silence/Background-Noise Encoder with DTX Module
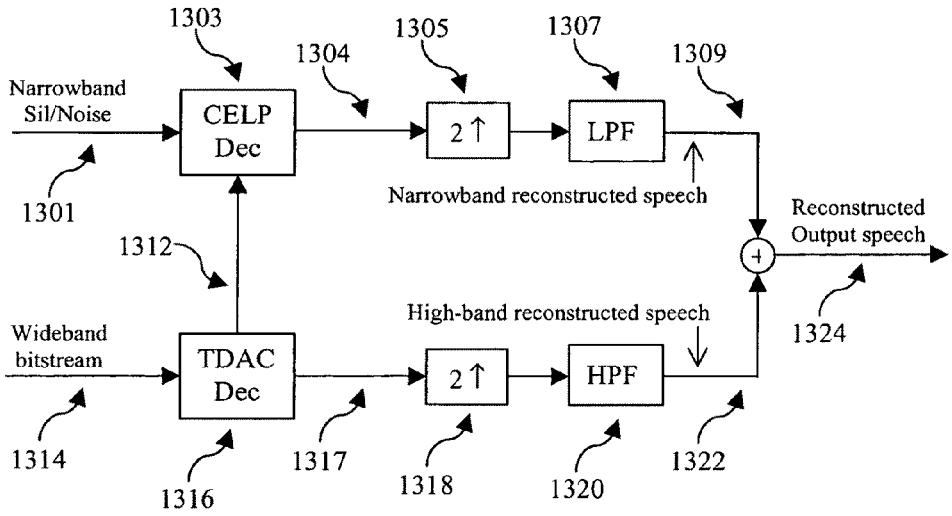
Figure 13: Structure of G.729.1 Decoder

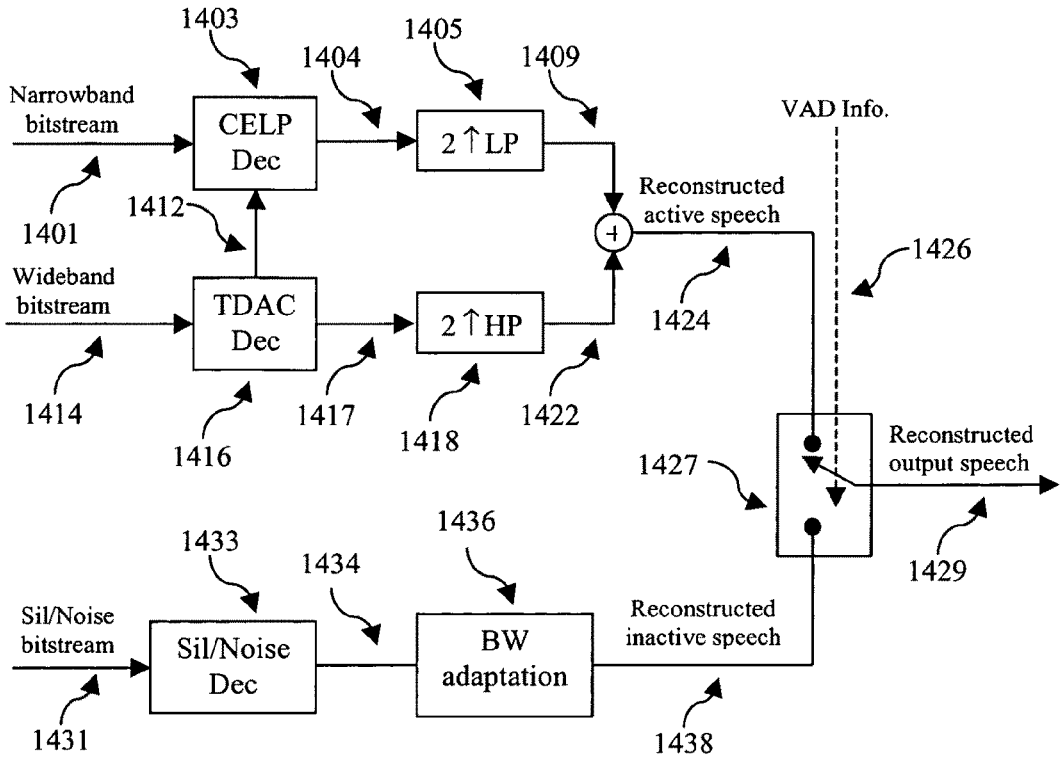
Figure 14: G.729.1 Decoder with Silence/Background-Noise Compression

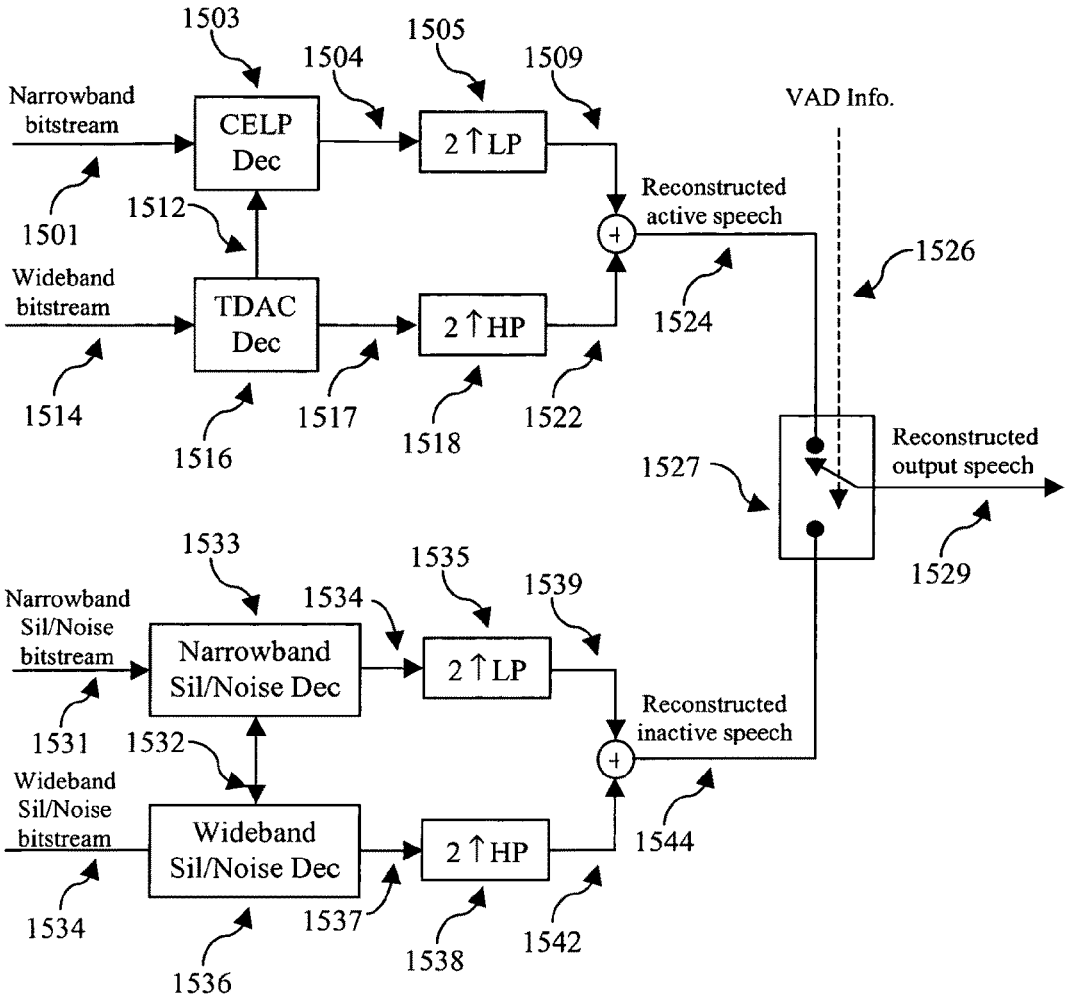
Figure 15: G.729.1 Decoder with an Embedded Silence/Background-Noise Compression

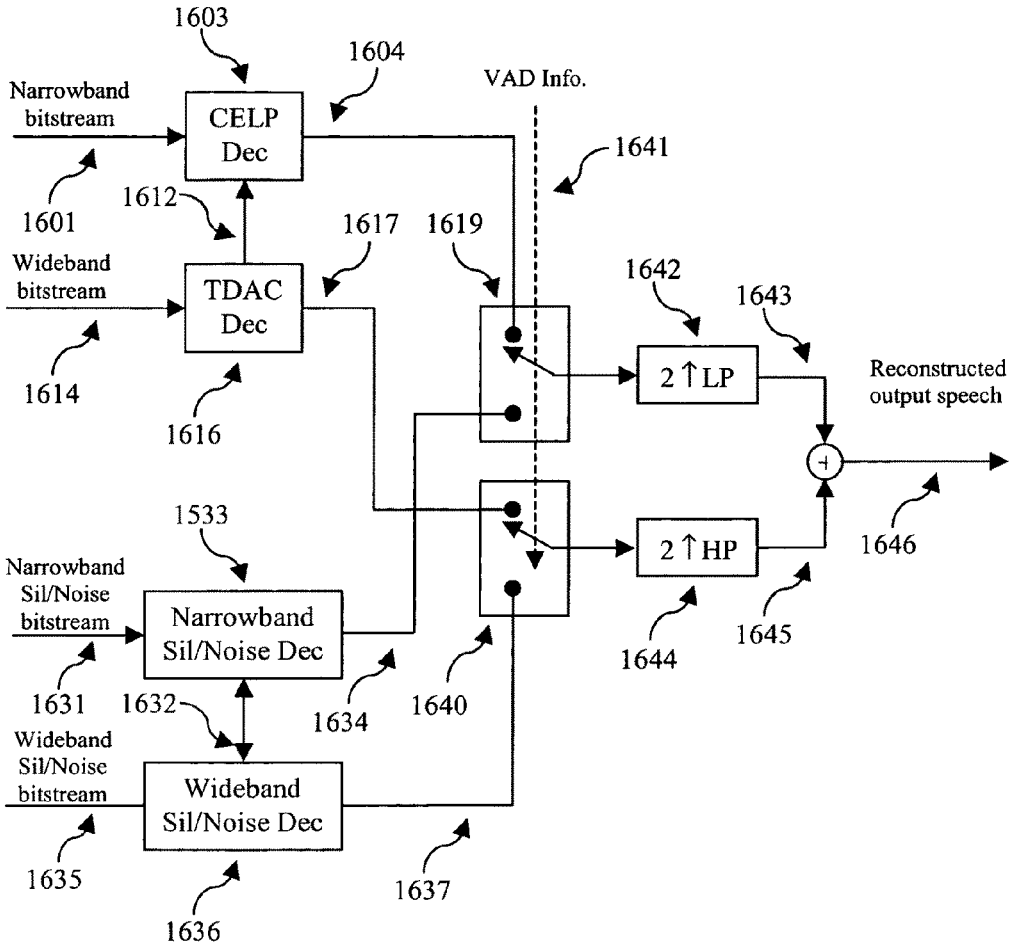
Figure 16: G.729.1 Decoder with an Embedded Silence/Background-Noise Compression and Shared Up-Sampling-and-Filtering Elements

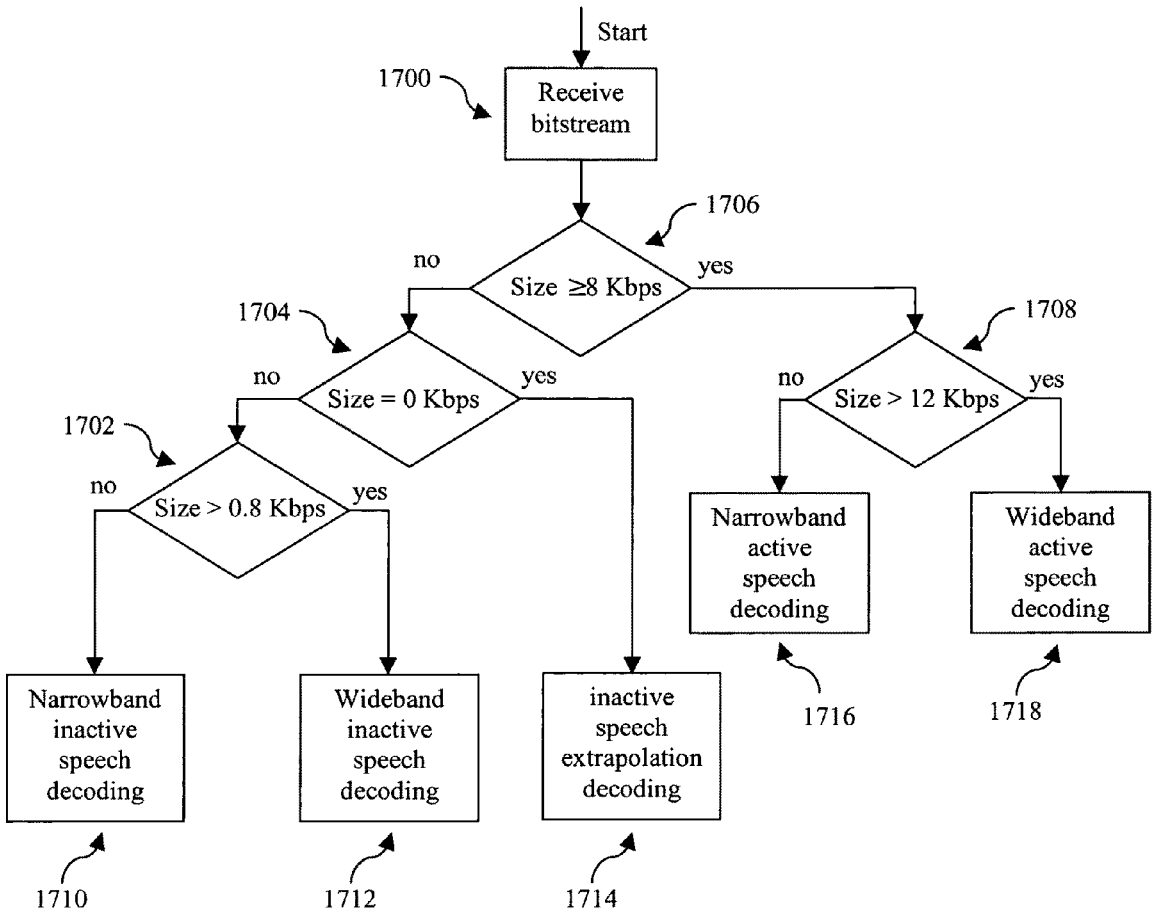
Figure 17: Decoder Control Operation Based on Bit Rate

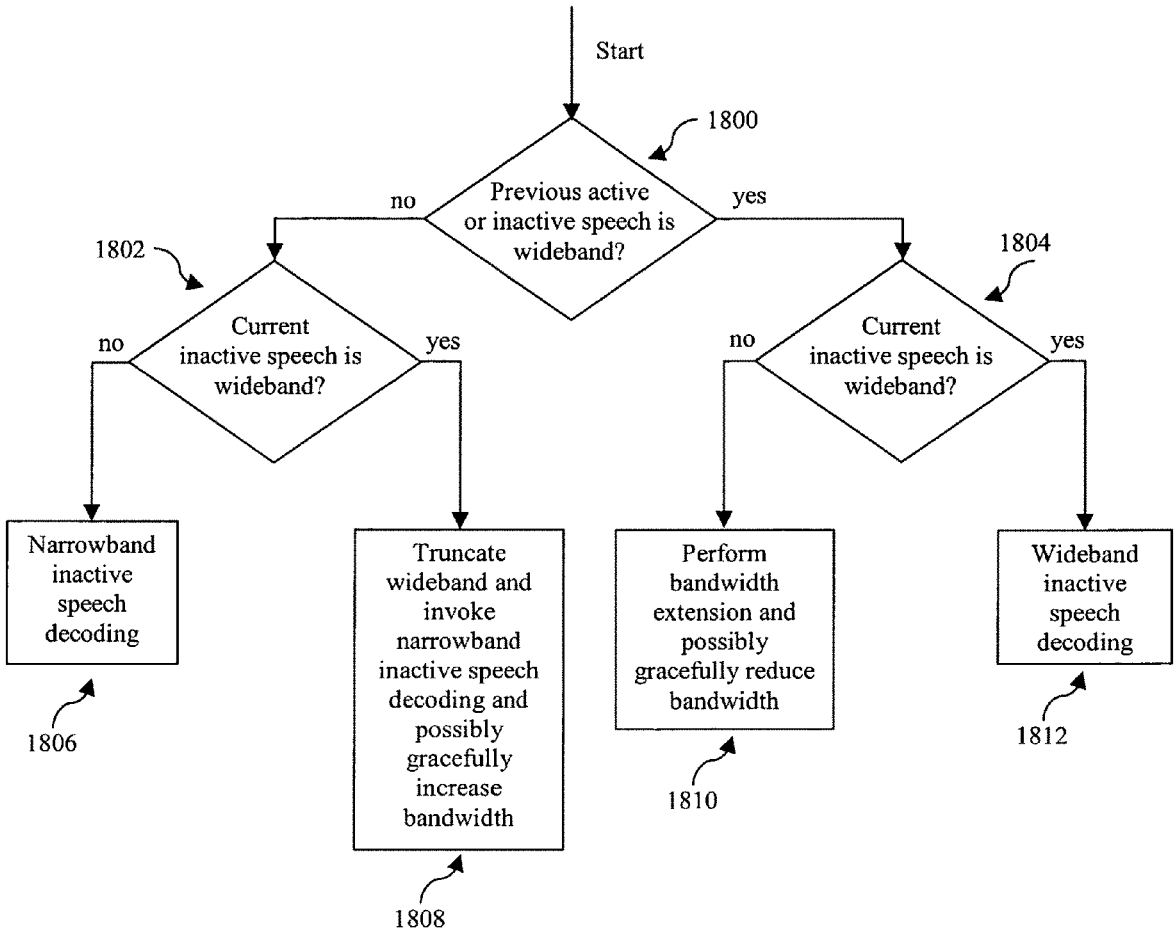
Figure 18: Decoder Control Operation Based on Bandwidth History

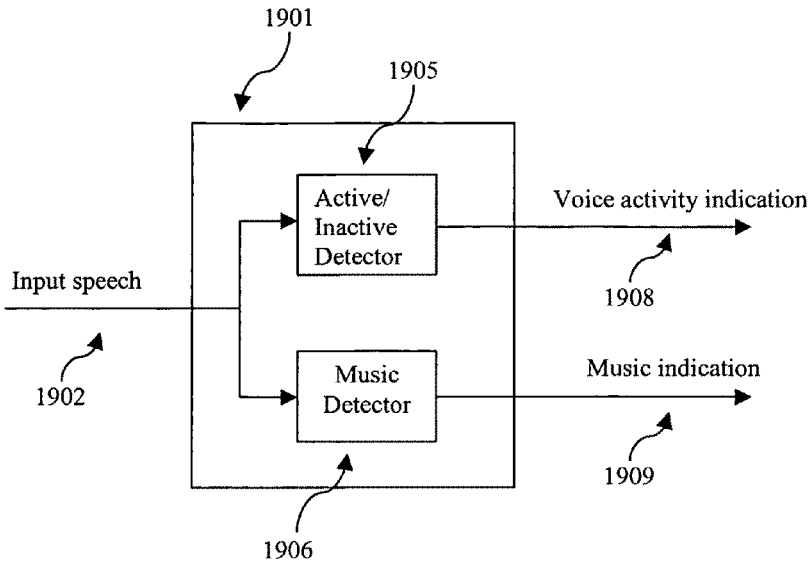
Figure 19: Generalized Voice Activity Detector with Music Detection
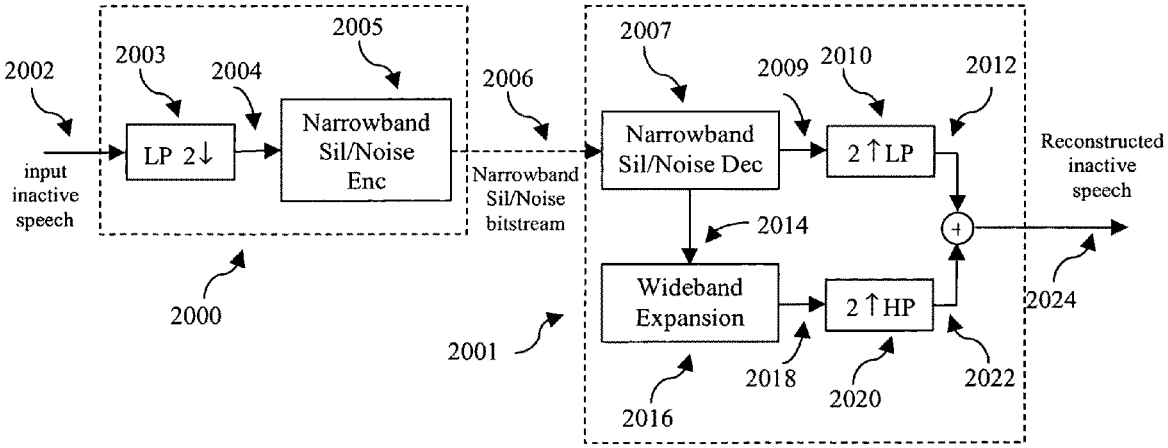
Figure 20: Narrowband Silence/Background-noise Transmission with Decoder Bandwidth Expansion

EMBEDDED SILENCE AND BACKGROUND NOISE COMPRESSION

RELATED APPLICATIONS

The present application is based on and claims priority to U.S. Provisional Application Ser. No. 60/901,191, filed Feb. 14, 2007, which is hereby incorporated by reference in its entirety.

BACKGROUND OF THE INVENTION

1. Field of the Invention

The present invention relates generally to the field of speech coding and, more particularly, to an embedded silence and noise compression.

2. Related Art

Modern telephony systems use digital speech communication technology. In digital speech communication systems the speech signal is sampled and transmitted as a digital signal, as opposed to analog transmission in the plain old telephone systems (POTS). Examples of digital speech communication systems are the public switched telephone networks (PSTN), the well established cellular networks and the emerging voice over internet protocol (VoIP) networks. Various speech compression (or coding) techniques, such as ITU-T Recommendations G.723.1 or G.729, can be used in digital speech communication systems in order to reduce the bandwidth required for the transmission of the speech signal.

Further bandwidth reduction can be achieved by using a lower bit-rate coding approach for the portions of the speech signal that have no actual speech, such as the silence periods that are present when a person is listening to the other talker and does not speak. The portions of the speech signal that include actual speech are called "active speech," and the portions of the speech signal that do not contain actual speech are referred to as "inactive speech." In general, inactive speech signals contain the ambient background noise in the location of the listening person as picked up by the microphone. In very quiet environment this ambient noise will be very low and the inactive speech will be perceived as silence, while in noisy environments, such as in a motor vehicle, inactive speech includes environmental background noise. Usually, the ambient noise conveys very little information and therefore can be coded and transmitted at a very low bit-rate. One approach to low bit-rate coding of ambient noise employs only a parametric representation of the noise signal, such as its energy (level) and spectral content.

Another common approach for bandwidth reduction, which makes use of the stationary nature of the background noise, is sending only intermittent updates of the background noise parameters, instead of continuous updates.

Bandwidth reduction can also be implemented in the network if the transmitted bitstream has an embedded structure. An embedded structure implies that the bitstream includes a core and enhancement layers. The speech can be decoded and synthesized using only the core bits while using the enhancement layers bits improves the decoded speech quality. For example, ITU-T Recommendation G.729.1, entitled "G.729-based embedded variable bit-rate coder: An 8-32 kbit/s scalable wideband coder bitstream interoperable with G.729," dated May 2006, which is hereby incorporated by reference in its entirety, uses a core narrowband layer and several narrowband and wideband enhancement layers.

The traffic congestion in networks that handle very large number of speech channels depends on the average bit rate used by each codec rather than the maximal rate used by each codec. For example, assume a speech codec that operates at a maximal bit rate of 32 Kbps but at an average bit rate of 16 Kbps. A network with a bandwidth of 1600 Kbps can handle about 100 voice channels, since on average all 100 channels will use only 100*16 Kbps=1600 Kbps. Obviously, in small probability, the overall required bit rate for the transmission of all channels might exceed 1600 Kbps, but if that codec also employs an embedded structure the network can easily resolve this problem by dropping some of the embedded layers of a number of channels. Of course, if the planning/operation of the network is based on the maximal bit rate of each channel, without taking into account the average bit rate and the embedded structure, the network will be able to handle only 50 channels.

SUMMARY OF THE INVENTION

In accordance with the purpose of the present invention as broadly described herein, there is provided a silence/background-noise compression in embedded speech coding systems. In one exemplary aspect of the present invention, a speech encoder capable of generating both an embedded active speech bitstream and an embedded inactive speech bitstream is disclosed. The speech encoder receives input speech and uses a voice activity detector (VAD) to determine if the input speech is an active speech or inactive speech. If the input speech is active speech, the speech encoder uses an active speech encoding scheme to generate an active speech embedded bitstream, which contains narrowband portions and wideband portions. If the input speech is inactive speech the speech encoder uses an inactive speech encoding scheme to generate an inactive speech embedded bitstream, which can contain narrowband portions and wideband portions. In addition, if the input speech is inactive speech, the speech encoder invokes a discontinuous transmission (DTX) scheme where only intermittent updates of the silence/background-noise information are sent. At the decoder side, the active and inactive bitstreams are received and different parts of the decoder are invoked based on the type of bitstream, as indicated by the size of the bitstream. Bandwidth continuity is maintained for inactive speech by ensuring that the bandwidth is smoothly changed, even if the inactive speech packet information indicates a change in the bandwidth.

These and other aspects of the present invention will become apparent with further reference to the drawings and specification, which follow. It is intended that all such additional systems, methods, features and advantages be included within this description, be within the scope of the present invention, and be protected by the accompanying claims.

BRIEF DESCRIPTION OF THE DRAWINGS

The features and advantages of the present invention will become more readily apparent to those ordinarily skilled in the art after reviewing the following detailed description and accompanying drawings, wherein:

FIG. 1 illustrates the embedded structure of a G.729.1 bitstream in accordance with one embodiment of the present invention;

FIG. 2 illustrates the structure of a G.729.1 encoder in accordance with one embodiment of the present invention;

FIG. 3 illustrates an alternative operation of a G.729.1 encoder with narrowband coding in accordance with one embodiment of the present invention;

FIG. 4 illustrates a silence/background-noise encoding mode for G.729.1 in accordance with one embodiment of the present invention;

FIG. 5 illustrates a silence/background-noise encoder with embedded structure in accordance with one embodiment of the present invention;

FIG. 6 illustrates silence/background-noise embedded bitstream in accordance with one embodiment of the present invention;

FIG. 7 illustrates an alternative silence/background-noise embedded bitstream in accordance with one embodiment of the present invention;

FIG. 8 illustrates a silence/background-noise embedded bitstream without optional layers in accordance with one embodiment of the present invention;

FIG. 9 illustrates a narrowband VAD for narrowband mode of operation of G.729.1 in accordance with one embodiment of the present invention;

FIG. 10 illustrates a silence/background-noise encoding mode for G.729.1 with narrowband VAD in accordance with one embodiment of the present invention;

FIG. 11 illustrates a silence/background-noise encoding mode for G.729.1 with narrowband VAD and separate decimation elements in accordance with one embodiment of the present invention;

FIG. 12 illustrates a silence/background-noise encoder with DTX module in accordance with one embodiment of the present invention;

FIG. 13 illustrates the structure of G.729.1 decoder in accordance with one embodiment of the present invention;

FIG. 14 illustrates a G.729.1 decoder with silence/background-noise compression in accordance with one embodiment of the present invention;

FIG. 15 illustrates a G.729.1 decoder with an embedded silence/background-noise compression in accordance with one embodiment of the present invention;

FIG. 16 illustrates a G.729.1 decoder with an embedded silence/background-noise compression and shared up-sampling-and-filtering elements in accordance with one embodiment of the present invention;

FIG. 17 illustrates decoder control flowchart operation based on bit rate in accordance with one embodiment of the present invention;

FIG. 18 illustrates decoder control flowchart operation based on bandwidth history in accordance with one embodiment of the present invention;

FIG. 19 shows a generalized voice activity detector in accordance with one embodiment of the present invention; and FIG. 20 shows a narrowband silence/background-noise transmission with decoder bandwidth expansion.

DESCRIPTION OF EXEMPLARY EMBODIMENTS

The present invention may be described herein in terms of functional block components and various processing steps. It should be appreciated that such functional blocks may be realized by any number of hardware components and/or software components configured to perform the specified functions. For example, the present invention may employ various integrated circuit components, e.g., memory elements, digital signal processing elements, logic elements, and the like, which may carry out a variety of functions under the control of one or more microprocessors or other control devices. Further, it should be noted that the present invention may employ any number of conventional techniques for data transmission, signaling, signal processing and conditioning, tone generation and detection and the like. Such general techniques that may be known to those skilled in the art are not described in detail herein.

It should be appreciated that the particular implementations shown and described herein are merely exemplary and are not intended to limit the scope of the present invention in any way. Indeed, for the sake of brevity, conventional data transmission, signaling and signal processing and other functional and technical aspects of the communication system (and components of the individual operating components of the system) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical communication system.

In packet networks, such as cellular or VoIP, the encoding and the decoding of the speech signal might be performed at the user terminals (e.g., cellular handsets, soft pones, SIP phones or WiFi/WiMax terminals). In such applications, the network serves only for the delivery of the packets which contain the coded speech signal information. The transmission of speech in packet networks eliminates the restriction on the speech spectral bandwidth, which exists in PSTN as inherited from the POTS analog transmission technology. Since the speech information is transmitted in a packet bitstream, which provides the digital compressed representation of the original speech, this packet bitstream can represent either a narrowband speech or a wideband speech. The acquisition of the speech signal by a microphone and its reproduction at the end terminals by an earpiece or a speaker, either as narrowband or wideband representation, depend only on the capability of such end terminals. For example, in current cellular telephony a narrowband cell phone acquires the digital representation of the narrowband speech and uses a narrowband codec, such as the adaptive multi-rate (AMR) codec, to communicate the narrowband speech with another similar cell phone via the cellular packet network. Similarly, a wideband capable cell phone can acquire a wideband representation of the speech and use a wideband speech code, such as AMR wideband (AMR-WB), to communicate the wideband speech with another wideband-capable cell phone via the cellular packet network. Obviously, the wider spectral content provided by a wideband speech codec, such as AMR-WB, will improve the quality, naturalness and intelligibility of the speech over a narrowband speech codec, such as AMR.

The newly adopted ITU-T Recommendation G.729.1 is targeted for packet networks and employs an embedded structure to achieve narrowband and wideband speech compression. The embedded structure uses a "core" speech codec for basic quality transmission of speech and added coding layers which improve the speech quality with each additional layer. The core of G.729.1 is based on ITU-T Recommendation G.729, which codes narrowband speech at 8 Kbps. This core is very similar to G.729, with a bitstream that is compatible with G.729 bitstream. Bitstream compatibility means that a bit stream generated by G.729 encoder can be decoded by G.729.1 decoder and a bitstream generated by G.729.1 encoder can be decoded by G.729 decoder, both without any quality degradation.

The first enhancement layer of G.729.1 over the core at 8 Kbps, is a narrowband layer at the rate of 12 Kbps. The next enhancement layers are ten (10) wideband layers from 14 Kbps to 32 Kbps. FIG. 1 depicts the structure of G.729.1 embedded bitstream with its core and 11 additional layers, where block 101 represents the core 8 Kbps layer, block 102 represents the first narrowband enhancement layer at 12 Kbps and blocks 103-112 represent the ten (10) wideband enhancement layers, from 14 Kbps to 32 Kbps at steps of 2 Kbps, respectively.

The encoder of G.729.1 generates the bit stream that includes all the 12 layers. The decoder of G.729.1 is capable of decoding any of the bit streams, starting from the bit stream of the 8 Kbps core codec up to the bitstream which includes all the layers at 32 Kbps. Obviously, the decoder will produce a better quality speech as higher layers are received. The decoder also allows changing the bit rate from one frame to the next with practically no quality degradation from switching artifacts. This embedded structure of G.729.1 allows the network to resolve traffic congestion problems without the need to manipulate or operate on the actual content of the bitstream. The congestion control is achieved by dropping some of the embedded-layers portions of the bitstream and delivering only the remaining embedded-layers portions of the bitstream.

FIG. 2 depicts the structure of G.729.1 encoder in accordance with one embodiment of the present invention. Input speech 201 is sampled at 16 KHz and passed through Low Pass Filter (LPF) 202 and High Pass Filter (HPF) 210, generating narrowband speech 204 and high-band-at-base-band speech 212 after down-sampling by decimation elements 203 and 211, respectively. Note that both the narrowband speech 204 and high-band-at-base-band speech 212 are sampled at 8 KHz sampling rate. The narrowband speech 204 is then coded by CELP encoder 205 to generate narrowband bitstream 206. The narrowband bitstream is decoded by CELP decoder 207 to generate decoded narrowband speech 208, which is subtracted from narrowband speech 204 to generate narrowband residual-coding signal 209. Narrowband residual-coding signal and high-band-at-base-band speech 212 are coded by Time-Domain Aliasing Cancellation (TDAC) encoder 213 to generate wideband bitstream 214. (We use the term "TDAC encoder" for the module that encodes high-band signal 212, although for the 14 Kbps layer the technology used is commonly known as Time-Domain Band Width Expansion (TD-BWE).) Narrowband bitstream 204 comprises of 8 Kbps layer 101 and 12 Kbps layer 102, while the wideband bitstream 214 comprises of layers 103-112, from 14 Kbps to 32 Kbps, respectively. The special TD-BWE mode of operation of G.729.1 for generating the 14 Kbps layer is not depicted in FIG. 2, for sake of simplifying the presentation. Also not shown is a packing element, which receives narrowband bitstream 206 and wideband bitstream 214 to create the embedded bit stream structure depicted in FIG. 1. Such a packing element is described, for example, in the Internet Engineering Task Force (IETF) request for comments number 4749 (RFC4749), "RTP Payload Format for the G.729.1 Audio Codec," which is hereby incorporated by reference in its entirety.

An alternative mode of operation of G.729.1 encoder is depicted in FIG. 3, where only narrowband coding is performed. Input speech 301, now sampled at 8 KHz, is input to CELP encoder 305, which generates narrowband bitstream 306. Similar to FIG. 2, narrowband bitstream 306 comprises of 8 Kbps layer 101 and 12 Kbps layer 102, as depicted in FIG. 1.

FIG. 4 provides an embodiment of G.729.1 with silence/background-noise encoding mode in accordance with one embodiment of the present invention. For simplicity, several elements in FIG. 2 are combined into a single element in FIG. 4. For example, LPF 202 and decimation element 203 are combined into LP-decimation element 403 and HPF 210 and decimation element 211 are combined into HP-decimation element 410. Similarly, CELP encoder 205, CELP decoder 207 and the adder element in FIG. 2 are combined into CELP encoder 405. Narrowband speech 404 is similar to narrowband speech 204, high-band speech 412 is similar to 212, TDAC encoder 413 is identical to 213, narrowband residual-coding signal 409 is identical to 209, narrowband bitstream 406 is identical to 206 and wideband bitstream 414 is identical to 214. The primary difference in FIG. 4 with respect to FIG. 2 is the addition of a silence/background-noise encoder, controlled by a wideband voice activity detector (WB-VAD) module 416, which receives input speech 401 and operates switch 402 in accordance with one embodiment of the present invention. The term WB-VAD is used because input speech 401 is a wideband speech sampled at 16 KHz. If WB-VAD module 416 detects an actual speech ("active speech") the input speech 401 is directed by switch 402 to a typical G.729.1 encoder, which is referred to herein as an "active speech encoder". If WB-VAD module 416 does not detect an actual speech, which means that input speech 401 is silence or background noise ("inactive speech"), input speech 401 is directed to silence/background-noise encoder 416, which generates silence/background-noise bitstream 417. Not shown in FIG. 4 are the bitstream multiplexing and packing modules, which are substantially similar to the multiplexing and packing modules used by other silence/background-noise compression algorithms such as Annex B of G.729 or Annex A of G.723.1 and are known to those skilled in the art.

Many approaches can be used for silence/background-noise bitstream 417 to represent the inactive portions of the speech. In one approach, the bitstream can represent the inactive speech signal without any separation in frequency bands and/or enhancement layers. This approach will not allow a network element to manipulate the silence/background-noise bitstream for congestion control, but might not be a severe deficiency since the bandwidth required to transmit the silence/background-noise bitstream is very small. The main drawback will be, however, for the decoder to implement a bandwidth control function as part of the silence/background-noise decoder to maintain bandwidth compatibility between the active speech signal and the inactive speech signal. FIG. 5 describes one embodiment of the present invention that includes a silence/background-noise (inactive speech) encoder with embedded structure suitable for the operation of G.729.1, which resolves these problems. Input inactive speech 501 is fed into LP-decimation element 503 and HP-decimation element 510, to generate narrowband inactive speech 504 and high-band-at-base-band inactive speech 512, respectively. Narrowband silence/background-noise encoder 505 receives narrowband inactive speech 504 and produces narrowband silence/background-noise bitstream 506. Since G.729.1 minimal operation of silence/background-noise decoder must comply with Annex B of G.729, narrowband silence/background-noise bitstream 506 must comply, at least in part, with Annex B of G.729. Narrowband silence/background-noise encoder 505 may be identical to the narrowband silence/background-noise encoder described in Annex B of G.729, but can also be different, as long as it produces a bitstream that complies (at least in part) with Annex B of G.729. Narrowband silence/background-noise encoder 505 can also produce low-to-high auxiliary signal 509. Low-to-high auxiliary signal 509 contains information which assists wideband silence/background-noise encoder 513 in coding of the high-band-in-base-band inactive speech 512. The information can be the narrowband reconstructed silence/background-noise itself or parameters such as energy (level) or spectral representation. Wideband silence/background-noise encoder 513 receives both high-band-in-base-band inactive speech 512 and auxiliary signal 509 and produces the wideband silence/background-noise bitstream 514. Wideband silence/background-noise encoder 513 can also produce high-to-low auxiliary signal 508, which contains information to assist narrowband silence/background-noise encoder 505 in coding of narrowband-band speech 504. Not shown in FIG. 5, similarly to FIG. 4, are the bitstream multiplexing and packing modules, which are known to those skilled in the art.

FIG. 6 provides a description of a silence/background-noise embedded bitstream, as can be produced by the silence/background-noise encoder of FIG. 5 in accordance with one embodiment of the present invention. Silence/background-noise embedded bitstream 600 comprises of Annex B of G.729 (G.729B) bitstream 601 at 0.8 Kbps, an optional embedded narrowband enhancement bitstream 602, a wideband base layer bitstream 603 and an optional embedded wideband enhancement bitstream 604. With respect to FIG. 5, narrowband silence/background-noise bitstream 506 comprises G.729B bitstream 601 and optional narrowband embedded bitstream 602. Further, wideband silence/background-noise bitstream 514 in FIG. 5 comprises wideband base layer bitstream 603 and optional wideband embedded bitstream 604. The structure of G.729B bitstream 601 is defined by Annex B of G.729. It includes 10 bits for the representation of the spectrum and 5 bits for the representation of the energy (level). Optional narrowband embedded bitstream 602 includes improved quantized representation of the spectrum and the energy (e.g., additional codebook stage for spectral representation or improved time-resolution of energy quantization), random seed information, or actual quantized waveform information. Wideband base layer bitstream 603 contains the quantized information for the representation of the high-band silence/background-noise signal. The information can include energy information as well as spectral information in Linear Prediction Coding (LPC) format, sub-band format, or other linear transform coefficients, such a Discrete Fourier Transform (DFT), Discrete Cosine Transform (DCT) or wavelet transform. Wideband base layer bitstream 603 can also contain, for example, random seed information or actual quantized waveform information. Optional wideband embedded bitstream 604 can include additional information, not included in wideband base layer bitstream 603, or improved resolution of the same information included in wideband base layer bitstream 603.

FIG. 7 provides an alternative embodiment of a silence/background-noise embedded bitstream in accordance with one embodiment of the present invention. In this alternative embodiment the order of bit-fields is different from the embodiment presented in FIG. 6, but the actual information in the bits is identical between the two embodiments. Similar to FIG. 6, the first portion of silence/background-noise embedded bitstream 700 is G.729B bitstream 701, but the second portion is the wideband base layer bitstream 703, followed by optional embedded narrowband enhancement bitstream 702 and then by optional embedded wideband enhancement bitstream 704.

The main difference between the embodiment in FIG. 6 and the alternative embodiment in FIG. 7 is the effect of bitstream truncation by the network. Bitstream truncation by the network on the embodiment described in FIG. 6 will remove all of the wideband fields before removing any of the narrowband fields. On the other hand, bitstream truncation on the alternative embodiment described in FIG. 7 removes the additional embedded enhancement fields of both the wideband and the narrowband before removing any of the fields of the base layers (narrowband or wideband).

If optional enhancement layers are not incorporated into the silence/background-noise embedded bitstream of G.729.1, bitstreams 600 and 700 become identical. FIG. 8 depicts such bitstream, which includes only G.729B bitstream 801 and wideband base layer bitstream 803. Although this bitstream does not include the optional embedded layers, it still maintains an embedded structure, where a network element can remove wideband base layer bitstream 803 while maintaining G.729B bitstream 801. In another option, G.729B bitstream 801 can be the only bitstream transmitted by the encoder for inactive speech even when the active speech encoder transmits an embedded bitstream which includes both narrowband and wideband information. In such case, if the decoder receives the full embedded bitstream for active speech but only the narrowband bitstream for inactive speech it can perform a bandwidth extension for the synthesized inactive speech to achieve a smooth perceptual quality for the synthesized output signal.

One of the main problems in operating a silence/background-noise encoding scheme according to FIG. 4 is that the input to WB-VAD 416 is wideband input speech 401. Therefore, if one desires to use only the narrowband mode of operation of G.729.1 (as described in FIG. 3,) but with silence/background-noise coding scheme, another VAD, which can operate on narrowband signals, should be used.

One possible solution is to use a special narrowband VAD (NB-VAD) for the particular narrowband mode of operation of G.729.1. Such a solution in accordance with one embodiment of the present invention, is described in FIG. 9, where narrowband input speech 901 is the input to NB-VAD 916, which controls switch 902. Whether NB-VAD 916 detects active speech or inactive speech, input speech 901 is routed to CELP encoder 905 or to narrowband silence/background-noise encoder 916, respectively. CELP encoder 905 generates narrowband bitstream 906 and narrowband silence/background-noise encoder 916 generates narrowband silence/background-noise bitstream 917. The overall operation of this mode of G.729.1 is very similar to Annex B of G.729, and narrowband silence/background-noise bitstream 917 should be partially or fully compatible with Annex B of G.729. The main drawback of this approach is the need to incorporate both WB-VAD 416 and NB-VAD 916 in the standard and the code of G.729.1 silence/background-noise compression scheme.

The characteristics and features of active speech vs. inactive speech are evident in the narrowband portion of the spectrum (up to 4 KHz), as well as in the high-band portion of the spectrum (from 4 KHz to 7 KHz). Moreover, most of the energy and other typical speech features (such as harmonic structure) dominate more the narrowband portion rather than the high-band portion. Therefore, it is also possible to perform the voice activity detection entirely using the narrowband portion of the speech. FIG. 10 depicts a silence/background-noise encoding mode for G.729.1 with a narrowband VAD in accordance with one embodiment of the present invention. Input speech 1001 is received by LP-decimation 1002 and HP-decimation 1010 elements, to produce narrowband speech 1003 and high-band-at-base-band speech 1012, respectively. Narrowband speech 1003 is used by narrowband VAD 1004 to generate the voice activity detection signal 1005, which controls switch 1008. If voice activity signal 1005 indicates active speech, narrowband signal 1003 is routed to CELP encoder 1006 and high-band-in-base-band signal 1012 is routed to TDAC encoder 1016. CELP encoder 1006 generates narrowband bitstream 1007 and narrowband residual-coding signal 1009. Narrowband residual-coding signal 1009 serves as a second input to TDAC encoder 1016, which generates wideband bitstream 1014. If voice activity signal 1005 indicates inactive speech, narrowband signal 1003 is routed to narrowband silence/background-noise encoder 1017 and high-band-in-base-band signal 1012 is routed to wideband silence/background-noise encoder 1020. Narrowband silence/background-noise encoder 1017 generates narrowband silence/background-noise bitstream 1016 and wideband silence/background-noise encoder 1020 generates wideband silence/background-noise bitstream 1019. Bidirectional auxiliary signal 1018 represents the auxiliary information exchanged between narrowband silence/background-noise encoder 1017 and wideband silence/background-noise encoder 1020.

An underlying assumption for the system depicted in FIG. 10, is that narrowband signal 1003 and the high-band signal 1012, generated by LP-decimation 1002 and HP-decimation 1010 elements, respectively, are suitable for both the active speech encoding and the inactive speech encoding. FIG. 11 describes a system which is similar to the system presented in FIG. 10, but when different LP-decimation and HP-decimation elements are used for the preprocessing of the speech for active speech encoding and inactive speech encoding. This can be the case, for example, if the cutoff frequency for the active speech encoder is different from the cutoff frequency of the inactive speech encoder. Input speech 1101 is received by active speech LP-decimation element 1103 to produce narrowband speech 1109. Narrowband speech 1109 is used by narrowband VAD 1105 to generate the voice activity detection signal 1102, which controls switch 1113. If voice activity signal 1102 indicates active speech, input signal 1101 is routed to active speech LP-decimation element 1103 and active speech HP-decimation element 1108 to generate active speech narrowband signal 1109 and active speech high-band-in-base-band signal 1110, respectively. If voice activity signal 1102 indicates inactive speech, input signal 1101 is routed to inactive speech LP-decimation 1113 element and inactive speech HP-decimation element 1108 to generate inactive speech narrowband signal 1115 and inactive speech high-band-in-base-band signal 1120. It should be noted that the depiction of switch 1113 as operating on the input speech 1101 is only for the sake of clarity and simplification of FIG. 11. In practice, input speech 1101 may be fed continuously to all four decimation units (1103, 1108, 1113 and 1118) and the actual switching is performed on the four output signals (1109, 1110, 1115 and 1120). NB-VAD 1105 can use either active speech narrowband signal 1109 (as depicted in FIG. 11) or inactive speech narrowband signal 1115. Similar to FIG. 10, active speech narrowband signal 1109 is routed to CELP encoder 1106 which generates narrowband bit stream 1107 and narrowband residual-coding signal 1111. TDAC encoder 1116 receives active speech high-band-in-base-band signal 1110 and narrowband residual-coding signal 1111 to generate wideband bitstream 1112. Further, inactive speech narrowband signal 1115 is routed to narrowband silence/background-noise encoder 1119 which generates narrowband silence/background-noise bitstream 1117. Wideband silence/background-noise encoder 1123 receives inactive speech high-band signal 1120 and generate wideband silence/background-noise bitstream 1122. Bidirectional auxiliary signal 1121 represents the information exchanged between narrowband silence/background-noise encoder 1119 and wideband silence/background-noise encoder 1123.

Since inactive speech, which comprises of silence or background noise, holds much less information than active speech, the number of bits needed to represent inactive speech is much smaller than the number of bits used to describe active speech. For example, G.729 uses 80 bits to describe active speech frame of 10 ms but only 16 bits to describe inactive speech frame of 10 ms. This reduced number of bits helps in reducing the bandwidth required for the transmission of the bitstream. Further reduction is possible if, for some of the inactive speech frame, the information is not sent at all. This approach is called discontinuous transmission (DTX) and the frames where the information is not transmitted are simply called non-transmission (NT) frames. This is possible if the input speech characteristics in the NT frame did not change significantly from the previously sent information, which can be several frames in the past. In such case, the decoder can generate the output inactive speech signal for the NT frame based on the previously received information. FIG. 12 shows a silence/background-noise encoder with a DTX module in accordance with one embodiment of the present invention. The structure and the operation of the silence/background-noise encoder are very similar to the silence/background-noise encoder described as part of FIG. 11. Input inactive speech 1201 is routed to inactive speech LP-decimation 1203 and inactive speech HP-decimation 1216 elements to generate narrowband inactive speech 1205 and high-band-in-base-band inactive speech 1218, respectively. Further, narrowband inactive speech 1205 is routed to narrowband silence/background-noise encoder 1206, which generates narrowband silence/background-noise bitstream 1207. Wideband silence/background-noise encoder 1220 receives high-band-in-base-band inactive speech 1218 and generates wideband silence/background-noise bitstream 1222. Bidirectional auxiliary signal 1214 represents the information exchanged between narrowband silence/background-noise encoder 1206 and wideband silence/background-noise encoder 1220. The main difference is in the introduction of DTX element 1212, which generates DTX control signal 1213. Narrowband silence/background-noise encoder 1206 and wideband silence/background-noise encoder 1220 receive DTX control signal 1213, which indicate when to send narrowband silence/background-noise bitstream 1207 and wideband silence/background-noise bitstream 1222. A more advanced DTX element, not depicted in FIG. 12, can produce a narrowband DTX control signal that indicates when to send narrowband silence/background-noise bitstream 1207, as well as a separate wideband DTX control signal that indicates when to send wideband silence/background-noise bitstream 1222. In this example embodiment, DTX element 1212 can use several inputs, including input inactive speech 1201, narrowband inactive speech 1205, high-band-in-base-band inactive speech 1218 and clock 1210. DTX element 1212 can also use speech parameters calculated by the VAD module (shown in FIG. 11 but omitted from FIG. 12), as well as parameters calculated by any of the encoding elements in the system, either active speech encoding element or inactive speech encoding element (these parameter paths are omitted from FIG. 12 for simplicity and clarity). The DTX algorithm, implemented in DTX element 1212, decides when an update of the silence/background information is needed. The decision can be made based for example, on any of the DTX input parameters (e.g. the level of input inactive speech 1201), or based on time intervals measured by clock 1210. The bitstream send for an update of the silence/background information is called silence insertion description (SID).

A DTX approach can be used also for the non-embedded silence compression depicted in FIG. 4. Similarly, a DTX approach can be used also for the narrowband mode of operation of G.729.1, depicted in FIG. 9. The communication systems for packing and transmitting the bitstreams from the encoder side to the decoder side and for the receiving and unpacking of the bitstreams by the decoder side are well known to those skilled in the art and are thus not described in detail herein.

FIG. 13 illustrates a typical decoder for G.729.1, which decodes the bitstream presented in FIG. 2. Narrowband bitstream 1301 is received by CELP decoder 1303 and wideband bitstream 1314 is received by TDAC decoder 1316. TDAC decoder 1316 generates high-band-at-base-band signal 1317, as well as reconstructed weighted difference signal 1312 with is received by CELP decoder 1303. CELP decoder 1303 generates narrowband signal 1304. Narrowband signal 1304 is processed by up-sampling element 1305 and low-pass filter 1307 to generate narrowband reconstructed speech 1309. High-band-at-base-band signal 1317 is processed by up-sampling element 1318 and high-pass filter 1320 to generate high-band reconstructed speech 1322. Narrowband reconstructed speech 1309 and high-band reconstructed speech 1322 are added to generate output reconstructed speech 1324. Similar to the discussion above of the encoder, we use the term "TDAC decoder" for the module that decodes wideband bitstream 1314, although for the 14 Kbps layer the technology used is commonly known as Time-Domain Band Width Expansion (TD-BWE).

FIG. 14 provides a description of a G.729.1 decoder with a silence/background-noise compression in accordance with one embodiment of the present invention, which is suitable to receive and decode the bitstream generated by a G.729.1 encoder with a silence/background-noise compression as depicted in FIG. 4. The top portion of FIG. 14, which describes the active speech decoder, is identical to FIG. 13, with the up-sampling and the filtering elements combined into one. Narrowband bitstream 1401 is received by CELP decoder 1403 and wideband bitstream 1414 is received by TDAC decoder 1416. TDAC decoder 1416 generates high-band-at-base-band active speech 1417, as well as reconstructed weighted difference signal 1412 with is received by CELP decoder 1403. CELP decoder 1403 generates narrowband active speech 1404. Narrowband Active speech 1404 is processed by up-sampling-LP element 1405 to generate narrowband reconstructed active speech 1409. High-band-at-base-band active speech 1417 is processed by up-sampling-HP element 1418 to generate high-band reconstructed active speech 1422. Narrowband reconstructed active speech 1409 and high-band reconstructed active speech 1422 are added to generate reconstructed active speech 1424. The bottom section of FIG. 14 provides a description of the silence/background-noise (inactive speech) decoding. Silence/background-noise bitstream 1431 is received by silence/background-noise decoder 1433 which generates wideband reconstructed inactive speech 1434. Since the active speech decoder can generate either wideband signal or narrowband signal, depending on the number of embedded layers retained by the network, it is important to ensure that no bandwidth switching perceptual artifacts are heard in the final reconstructed output speech 1429. Therefore, wideband reconstructed inactive speech 1434 is fed into bandwidth (BW) adaptation module 1436, which generates reconstructed inactive speech 1438 by matching its bandwidth to the bandwidth of reconstructed active speech 1429. The active speech bandwidth information can be provided to BW adaptation module 1436 by the bitstream unpacking module (not shown), or from the information available in the active speech decoder, e.g., within the operation of CELP decoder 1403 and TDAC decoder 1416. The active speech bandwidth information can also be directly measured on reconstructed active speech 1424. At the last step, based on VAD information 1426, which indicates whether active bitstream (comprises of narrowband bitstream 1401 and wideband bitstream 1414) or silence/background-noise bitstream was received, switch 1427 selects between reconstructed active speech 1424 and reconstructed inactive speech 1438, respectively, to form reconstructed output speech 1429.

FIG. 15 provides a description of a G.729.1 decoder with an embedded silence/background-noise compression in accordance with one embodiment of the present invention, which is suitable to receive and decode the bitstream generated by a G.729.1 encoder with an embedded silence/background-noise compression as depicted, for example, in FIGS. 10 and 11. The top portion of FIG. 15, which describes the active speech decoder, is identical to FIGS. 13 and 14, with the up-sampling and the filtering elements combined into one. Narrowband bitstream 1501 is received by active speech CELP decoder 1503 and wideband bitstream 1514 is received by active speech TDAC decoder 1516. Active speech TDAC decoder 1516 generates high-band-at-base-band active speech 1517, as well as active speech reconstructed weighted difference signal 1512 which is received by active speech CELP decoder 1503. Active speech CELP decoder 1503 generates narrowband active speech 1504. Narrowband active speech 1504 is processed by active speech up-sampling-LP element 1505 to generate narrowband reconstructed active speech 1509. High-band-at-base-band active speech 1517 is processed by active speech up-sampling-HP element 1518 to generate high-band reconstructed active speech 1522. Narrowband reconstructed active speech 1509 and high-band reconstructed active speech 1522 are added to generate reconstructed active speech 1524. The bottom portion of FIG. 15 describes the inactive speech decoder. Narrowband silence/background-noise bitstream 1531 is received by narrowband silence/background-noise decoder 1533 and silence/background-noise wideband bitstream 1534 is received by wideband silence/background-noise decoder 1536. Narrowband silence/background-noise decoder 1533 generates silence/background-noise narrowband signal 1534 and wideband silence/background-noise decoder 1536 generates silence/background-noise high-band-at-base-band signal 1537. Bidirectional auxiliary signal 1532 represents the information exchanged between narrowband silence/background-noise decoder 1533 and wideband silence/background-noise decoder 1536. Silence/background-noise narrowband signal 1534 is processed by silence/background-noise up-sampling-LP element 1535 to generate silence/background-noise narrowband reconstructed signal 1539. Silence/background-noise high-band-at-base-band signal 1537 is processed by silence/background-noise up-sampling-HP element 1538 to generate silence/background-noise high-band reconstructed signal 1542. Silence/background-noise narrowband reconstructed signal 1539 and silence/background-noise high-band reconstructed signal 1542 are added to generate reconstructed inactive speech 1544. Based on VAD information 1526, which indicates whether active bitstream (comprises of narrowband bitstream 1501 and wideband bitstream 1514) or inactive bit stream (comprises of narrowband silence/background-noise bitstream 1531 and silence/background-noise wideband bitstream 1534) was received, switch 1527 selects between reconstructed active speech 1524 and reconstructed inactive speech 1544, respectively, to form reconstructed output speech 1529. Obviously, the order of the switching and of the summation is interchangeable, and another embodiment can be where one switch selects between the narrowband signals and another switch selects between the wideband signals, while a signal summation element combines the output of the switches.

In FIG. 15, the up-sampling-LP and up-sampling-HP elements are different for active speech and inactive speech, assuming that different processing (e.g., different cutoff frequencies) is needed. If the processing in the up-sampling-LP and up-sampling-HP elements is identical between active speech and inactive speech, the same elements can be used for both types of speech. FIG. 16 describes G.729.1 decoder with an embedded silence/background-noise compression where the up-sampling-LP and up-sampling-HP elements are shared between active speech and inactive speech. Narrowband bitstream 1601 is received by active speech CELP decoder 1603 and wideband bitstream 1614 is received by active speech TDAC decoder 1616. Active speech TDAC decoder 1616 generates high-band-at-base-band active speech 1617, as well as active speech reconstructed weighted difference signal 1612 with is received by active speech CELP decoder 1603. Active speech CELP decoder 1603 generates narrowband active speech 1604. Narrowband silence/background-noise bitstream 1631 is received by narrowband silence/background-noise decoder 1633 and silence/background-noise wideband bitstream 1635 is received by wideband silence/background noise decoder 1636. Narrowband silence/background-noise decoder 1633 generates silence/background-noise narrowband signal 1634 and wideband silence/background-noise decoder 1636 generates silence/background-noise high-band-at-base-band signal 1636. Bidirectional auxiliary signal 1632 represents the information exchanged between narrowband silence/background-noise decoder 1633 and wideband silence/background-noise decoder 1636. Based on VAD information 1641, switch 1619 directs either narrowband active speech 1604 or silence/background-noise narrowband signal 1634 to up-sampling-LP elements 1642, which produces narrowband output signal 1643. Similarly, based on VAD information 1641, switch 1640 directs either high-band-at-base-band active speech 1617 or silence/background-noise high-band-at-base-band signal 1636 to up-sampling-HP elements 1644, which produces high-band output signal 1645. Narrowband output signal 1643 and high-band output signal 1645 are summed to produce reconstructed output speech 1646.

The silence/background-noise decoders described in FIGS. 14, 15 and 16 can alternatively incorporate a DTX decoding algorithm in accordance with alternate embodiments of the present invention, where the parameters used for generating the reconstructed inactive speech are extrapolated from previously received parameters. The extrapolation process is known to those skilled in the art and is not described in detail herein. However, if one DTX scheme is used by the encoder for narrowband inactive speech and another DTX scheme is used by the encoder for high-band inactive speech, the updates and the extrapolation at the narrowband silence/background-noise decoder will be different from the updates and the extrapolation at the wideband silence/background-noise decoder.

G.729.1 decoder with embedded silence/background-noise compression operates in many different modes, according to the type of bitstream it receives. The number of bits (size) in the received bitstream determines the structure of the received embedded layers, i.e., the bit rate, but the number of bits in the received bitstream also establishes the VAD information at the decoder. For example, if a G.729.1 packet, which represents 20 ms of speech, holds 640 bits, the decoder will determine that it is an active speech packet at 32 Kbps and will invoke the complete active speech wideband decoding algorithm. On the other hand, if the packet holds 240 bits for the representation of 20 ms of speech the decoder will determine that it is an active speech packet at 12 Kbps and will invoke only the active speech narrowband decoding algorithm. For G.729.1 with silence/background compression, if the size of the packet is 32 bits, the decoder will determine it is an inactive speech packet with only narrowband information and will invoke the inactive speech narrowband decoding algorithm, but if the size of the packet is 0 bits (i.e., no packet arrived) it will be considered as an NT frame and the appropriate extrapolation algorithm will be used. The variations in the size of the bitstream are caused by either the speech encoder, which uses active or inactive speech encoding based on the input signal, or by a network element which reduces congestion by truncating some of the embedded layers. FIG. 17 presents a flowchart of the decoder control operation based on the bit rate, as determined by the size of the bitstream in the received packets. It is assumed that the structure of the active speech bitstream is as depicted in FIG. 1 and that the structure of the inactive speech bitstream is as depicted in FIG. 8. The bitstream is received by receive module 1700. The bitstream size if first tested by active/inactive speech comparator 1706, which determines that it is an active speech bitstream if the bit rate is larger or equal to 8 Kbps (size of 160 bits) and inactive speech bitstream otherwise. If the bitstream is an active speech bitstream, its size is further compared by active speech narrowband/wideband comparator 1708, which determines if only the narrowband decoder should be invoked by module 1716 or if the complete wideband decoder should be invoked by module 1718. If comparator 1706 indicates an inactive speech bitstream, NT/SID comparator 1704 checks if the size of the bitstream is 0 (NT frame) or larger than 0 (SID frame). If the bitstream is an SID frame, the size of the bitstream is further tested by inactive speech narrowband/wideband comparator 1702 to determine if the SID information includes the complete wideband information or only the narrowband information, and invoking the complete inactive speech wideband decoder by module 1712 or only the inactive narrowband decoder by module 1710. If the size of the bitstream is 0, i.e., no information was received, the inactive speech extrapolation decoder is invoked by module 1714. It should be noted that the order of the comparators is not important for the operation of the algorithm and that the described order of the comparison operations was provided as an exemplary embodiment only.

It is possible that a network element will truncate the wideband embedded layers of active speech packets while leaving the wideband embedded layers of inactive speech packets unchanged. This is because the removal of the large number of bits in the wideband embedded layers of active speech packet can contribute significantly for congestion reduction, while truncating the wideband embedded layers of inactive speech packets will contribute only marginally for congestion reduction. Therefore, the operation of inactive speech decoder also depends on the history of operation of the active speech decoder. In particular, special care should be taken if the bandwidth information in the currently received packet is different from the previously received packets. FIG. 18 provides a flowchart showing the steps of an algorithm that uses previous and current bandwidth information in inactive speech decoding. Decision module 1800 tests if the previous bitstream information was wideband. If the previous bitstream was wideband, the current inactive speech bitstream is tested by decision module 1804. If the current inactive speech bitstream is wideband, the inactive speech wideband decoder is invoked. If the current inactive speech bitstream is narrowband, bandwidth expansion is performed in order to avoid sharp bandwidth changes on the output silence/background-noise signal. Further, graceful bandwidth reduction can be performed if the received bandwidth remains narrowband for a predetermined number of packets. If decision module 1800 determines that previous bitstream was narrowband, the current inactive speech bitstream is tested by decision module 1802. If the inactive speech bitstream is narrowband, the inactive speech narrowband inactive speech decoder is invoked. If the current inactive speech bitstream is wideband, the wideband portion of the inactive speech bitstream is truncated and the narrowband inactive speech decoder is invoked, avoiding sharp bandwidth changes on the output silence/background-noise signal. Further, graceful bandwidth increase can be performed if the received bandwidth remains wideband for a predetermined number of packets. It should be noted that the inactive speech extrapolation decoder, although not implicitly specified in FIG. 18, is considered to be part of the inactive speech decoder and always follows the previously received bandwidth.

The VAD modules presented in FIGS. 4, 9, 10 and 11 discriminate between active speech and inactive speech, which is defined as the silence or the ambient background noise. Many current communication applications use music signals in addition to voice signals, such as in music on hold or personalized ring-back tones. Music signals are neither active speech nor inactive speech, but if the inactive speech encoder is invoked for segments of music signal, the quality of the music signal can be severely degraded. Therefore, it is important that a VAD in a communication system designed to handle music signals detects the music signals and provides a music detection indication. The detection and handling of music signals is even more important in speech communication systems that use wideband speech, since the intrinsic quality of the active speech codec for music signal is relatively high and therefore the quality degradation resulted from using the inactive speech codec for music signals might have stronger perceptual impact. FIG. 19 shows a generalized voice activity detector 1901, which receives input speech 1902. Input speech 1902 is fed into active/inactive speech detector 1905, which is similar to the VADs modules presented in FIGS. 4, 9, 10 and 11, and into music detector 1906. Active/inactive speech detector 1905 generates active/inactive voice indication 1908 and music detector 1906 generates music indication 1909. Music indication can be used in several ways. Its main goal is to avoid using the inactive speech encoder and for that task it can be combined with the active/inactive speech indicator by overriding an incorrect inactive speech decision. It can also control a proprietary or standard noise suppression algorithm (not shown) which preprocesses the input speech before it reaches the encoder. The music indication can also control the operation of the active speech encoder, such as its pitch contour smoothing algorithm or other modules.

The truncation of a wideband enhancement layer of inactive speech by the network might require the decoder to expand the bandwidth to maintain bandwidth continuity between the active speech segments and inactive speech segments. Similarly, it is possible for the encoder to send only narrowband information and for the decoder to perform the bandwidth expansion if the active speech is wideband speech. FIG. 20 depicts inactive speech encoder 2000 which receives input inactive speech 2002 and transmits silence/background-noise bitstream 2006 to inactive speech decoder 2001 which generates reconstructed inactive speech 2024. Note that both input inactive speech 2002 and reconstructed inactive speech 2024 are wideband signals, sampled at 16 KHz. LP-decimation element 2003 receives input inactive speech 2002 and generates inactive speech narrowband signal 2004, which is received by narrowband silence/background-noise encoder 2005 to generate narrowband silence/background-noise bitstream 2006. Narrowband silence/background-noise bitstream 2006 is received by narrowband silence/background-noise decoder 2007 which generates narrowband inactive speech 2009 and auxiliary signal 2014. Auxiliary signal 2014 can include energy and spectral parameters, as well as narrowband inactive speech 2009 itself. Wideband expansion module 2016 uses auxiliary signal 2014 to generate high-band-in-base-band inactive speech 2018. The generation can use spectral extension applied to wideband random excitation with energy contour matching and smoothing. Up-sampling-LP 2010 receives narrowband inactive speech 2009 and generates low-band output inactive speech 2012. Up-sampling-HP 2020 receives high-band-in-base-band inactive speech 2018 and generates high-band output inactive speech 2022. Low-band output inactive speech 2012 and high-band output inactive speech 2022 are added to create reconstructed inactive speech 2024.

The methods and systems presented above may reside in software, hardware, or firmware on the device, which can be implemented on a microprocessor, digital signal processor, application specific IC, or field programmable gate array ("FPGA"), or any combination thereof, without departing from the spirit of the invention. Furthermore, the present invention may be embodied in other specific forms without departing from its spirit or essential characteristics. The described embodiments are to be considered in all respects only as illustrative and not restrictive.

What is claimed is:

1. A method for use by a speech encoder to encode an input speech signal, the method comprising:

receiving the input speech signal;

determining whether the input speech signal includes an active speech signal or an inactive speech signal;

low-pass filtering the inactive speech signal to generate a narrowband inactive speech signal;

high-pass filtering the inactive speech signal to generate a high-band inactive speech signal;

generating a high-to-low auxiliary signal by a wideband inactive speech encoder based on the high-band inactive speech signal;

encoding the narrowband inactive speech signal using a narrowband inactive speech encoder to generate an encoded narrowband inactive speech based on the high-to-low auxiliary signal from the wideband inactive speech encoder;

generating a low-to-high auxiliary signal by the narrowband inactive speech encoder based on the narrowband inactive speech signal;

encoding the high-band inactive speech signal using the wideband inactive speech encoder to generate an encoded wideband inactive speech based on the low-to-high auxiliary signal from the narrowband inactive speech encoder; and transmitting the encoded narrowband inactive speech and the encoded wideband inactive speech.

2. The method of claim 1, wherein the transmitting includes a discontinuous transmission (DTX) scheme.

3. A method for use by a speech encoder including a wideband inactive speech encoder and a narrowband inactive speech encoder to encode an input speech signal, the method comprising:

receiving the input speech signal;

determining whether the input speech signal includes an active speech signal or an inactive speech signal;

low-pass filtering the inactive speech signal to generate a narrowband inactive speech signal;

high-pass filtering the inactive speech signal to generate a high-band inactive speech signal;

generating, using the wideband inactive speech encoder, a high-to-low auxiliary signal based on the high-band inactive speech signal;

encoding, using the narrowband inactive speech encoder, the narrowband inactive speech signal using the high-to-low auxiliary signal and in accordance with ITU-T G.729 Annex B Recommendation to generate a G.729B encoded narrowband inactive speech;

encoding, using the wideband inactive speech encoder, the high-band inactive speech signal to generate an encoded wideband inactive speech;

transmitting the G.729B encoded narrowband inactive speech as a G.729B bitstream; and transmitting the encoded wideband inactive speech as a wideband base layer bitstream following the G.729B bitstream.

4. The method of claim 3 further comprising:

encoding the narrowband inactive speech signal to generate an enhanced narrowband base layer bitstream;

transmitting the enhanced narrowband base layer bitstream following the wideband base layer bitstream.

5. The method of claim 4 further comprising:

encoding the high-band inactive speech signal to generate an enhanced wideband base layer bitstream;

transmitting the enhanced wideband base layer bitstream following the enhanced narrowband base layer bitstream.

6. The method of claim 3 further comprising:

encoding the high-band inactive speech signal to generate an enhanced wideband base layer bitstream;

transmitting the enhanced wideband narrowband base layer bitstream following the wideband base layer bitstream.

7. The method of claim 6 further comprising:

encoding the narrowband inactive speech signal to generate an enhanced narrowband base layer bitstream;

transmitting the enhanced narrowband base layer bitstream following the enhanced wideband base layer bitstream.

8. A method for use by a speech encoder to encode an input speech signal, the method comprising:

receiving the input speech signal;

low-pass filtering the input speech signal to generate a narrowband speech signal;

high-pass filtering the input speech signal to generate a high-band speech signal;

determining whether the narrowband input speech signal includes an active speech signal or an inactive speech signal;

generating a high-to-low auxiliary signal by a wideband inactive speech encoder based on the high-band speech signal;

encoding the narrowband speech signal using a narrowband inactive speech encoder to generate an encoded narrowband inactive speech based on the high-to-low auxiliary signal from the wideband inactive speech encoder if the determining determines that the narrowband speech signal includes the inactive speech signal;

encoding the high-band speech signal using the wideband inactive speech encoder to generate an encoded wideband inactive speech if the determining determines that the narrowband speech signal includes the inactive speech signal; and transmitting the encoded narrowband inactive speech and the encoded wideband inactive speech.

9. The method of claim 8 further comprising:

generating a low-to-high auxiliary signal by the narrowband inactive speech encoder based on the narrowband speech signal;

wherein the wideband inactive speech encoder encodes the high-band speech signal based on the low-to-high auxiliary signal from the narrowband inactive speech encoder.

10. The method of claim 8, wherein the transmitting includes a discontinuous transmission (DTX) scheme.

11. A speech encoder adapted to encode an input speech signal, the speech encoder comprising:

a microprocessor configured to control:

a receiver configured to receive the input speech signal;

a voice activity detector configured to determine whether the input speech signal includes an active speech signal or an inactive speech signal;

a low-pass filter for low-pass filtering the inactive speech signal to generate a narrowband inactive speech signal;

a high-pass filter for high-pass filtering the inactive speech signal to generate a high-band inactive speech signal;

a narrowband inactive speech encoder configured to encode the narrowband inactive speech signal to generate an encoded narrowband inactive speech, and the narrowband inactive speech encoder further configured to generate a low-to-high auxiliary signal based on the narrowband inactive speech signal;

a wideband inactive speech encoder configured to encode the high-band inactive speech signal to generate an encoded wideband inactive speech based on the low-to-high auxiliary signal from the narrowband inactive speech encoder; and a transmitter configured to transmit the encoded narrowband inactive speech and the encoded wideband inactive speech;

wherein the wideband inactive speech encoder is further configured to generate a high-to-low auxiliary signal based on the high-band inactive speech signal, and wherein the narrowband inactive speech encoder is further configured to encode the narrowband inactive speech signal based on the high-to-low auxiliary signal from the wideband inactive speech encoder.

12. The speech encoder of claim 11, wherein the transmitter is configured to transmit according to a discontinuous transmission (DTX) scheme.

13. A speech encoder adapted to encode an input speech signal, the speech encoder comprising:

a microprocessor configured to control:

a receiver configured to receive the input speech signal;

a low-pass filter for low-pass filtering the input speech signal to generate a narrowband speech signal;

a high-pass filter for high-pass filtering the input speech signal to generate a high-band speech signal;

a voice activity detector (VAD) configured to determine whether the narrowband input speech signal includes an active speech signal or an inactive speech signal;

a narrowband inactive speech encoder configured to encode the narrowband speech signal to generate an encoded narrowband inactive speech if the VAD determines that the narrowband speech signal includes the inactive speech signal;

a wideband inactive speech encoder configured to encode the high-band speech signal to generate an encoded wideband inactive speech if the VAD determines that the narrowband speech signal includes the inactive speech signal; and a transmitter configured to transmit the encoded narrowband inactive speech and the encoded wideband inactive speech;

wherein the wideband inactive speech encoder is further configured to generate a high-to-low auxiliary signal based on the high-band speech signal, and wherein the narrowband inactive speech encoder is further configured to encode the narrowband speech signal based on the high-to-low auxiliary signal from the wideband inactive speech encoder.

14. The speech encoder of claim 13, wherein the narrowband inactive speech encoder is further configured to generate a low-to-high auxiliary signal based on the narrowband speech signal, and wherein the wideband inactive speech encoder is further configured to encode the high-band speech signal based on the low-to-high auxiliary signal from the narrowband inactive speech encoder.

* * * * *

UNITED STATES PATENT AND TRADEMARK OFFICE

CERTIFICATE OF CORRECTION

PATENT NO. : 8,032,359 B2
APPLICATION NO. : 12/002131
DATED : October 4, 2011
INVENTOR(S) : Shlomot et al.

It is certified that error appears in the above-identified patent and that said Letters Patent is hereby corrected as shown below:

In claim 6, column 17, line 34, "transmitting the enhanced wideband narrowband base" should be changed to -- transmitting the enhanced wideband base --.

Signed and Sealed this
Twentieth Day of December, 2011

David J. Kappos

David J. Kappos
*Director of the United States Patent and Trademark Office*